United States Patent [19]

Barton

[11] 4,340,947

[45] Jul. 20, 1982

[54] DUAL TIMING APPARATUS

[76] Inventor: Lyndon O. Barton, 26 Shull Dr., Newark, Del. 19711

[21] Appl. No.: 231,147

[22] Filed: Jan. 30, 1981

[51] Int. Cl.[3] ..... G04F 1/04

[52] U.S. Cl. ..... 368/93

[58] Field of Search ..... 368/89, 91, 93–95

[56] References Cited

U.S. PATENT DOCUMENTS 2,984,064 5/1961 Russell et al. ..... 368/95

3,522,701 8/1970 Perry ..... 84/484

4,236,242 11/1980 Barton ..... 368/95

4,538,846 12/1980 Barton ..... 368/93

*Primary Examiner*—Vit W. Miska

[57] ABSTRACT

The dual timing apparatus invented comprises an enclosure having a fluid-filled cavity, a body free to move within the fluid, and a rotatable means to measure and control playing times between opponents in concentration games such as Scrabble, chess, checkers, and the like.

6 Claims, 4 Drawing Figures

DUAL TIMING APPARATUS

BACKGROUND OF INVENTION

The object of this invention is to provide a dual timing apparatus which can be used to measure and control playing time in concentration games such as Scrabble, chess checkers, and the like. Specifically, this apparatus will allot to each player an equal amount of time for the game (for example, thirty minutes each for a one hour game), and also keep track of the accumulated times consumed by each player during the course of the game. Alternatively, the object is to provide the faster player the advantage of conserving more playing time than the slower opponent for later use if needed.

SUMMARY OF INVENTION

The dual timing device comprises a plate-type enclosure having a fluid-filled cavity, a body which is free to move, under influence of gravity or buoyancy, within the fluid, and a right angular base.

The enclosure and base are attached to each other such that the cavity changes position as the base is rotated in a vertical plane from one leg to another.

Time is measured as the moves into the fluid relative to one side of the cavity or the other.

OPERATION

Let it be assumed that two players, P1 and P2 are engaged in a game of Scrabble, chess, or checkers. In the orientation given in FIG. 1, the dual timing apparatus is set to time P1 while it is at rest insofar as P2's time is concerned. This is evident from the fact that the body, under gravity, can move only downward with respect to side 1 of the cavity, which is vertical, but has no movement with respect to side 2 which is horizontal. P1's time therefore runs until P1 completes his play and rotates the base for the unit to assume the orientation in FIG. 2. Now the body moves downward with respect to side 2 of the cavity and has no motion with respect to side 1. Thus, the process continues with each player taking turn until the game is completed or the allotted time for one of the players runs out.

To reset the timer for start of a new game, the body is first allowed to settle in a neutral corner between sides 1 and 2, then the plate is rotated or indexed through an angle of 180° within the base.

FIGURES

Figure 1:
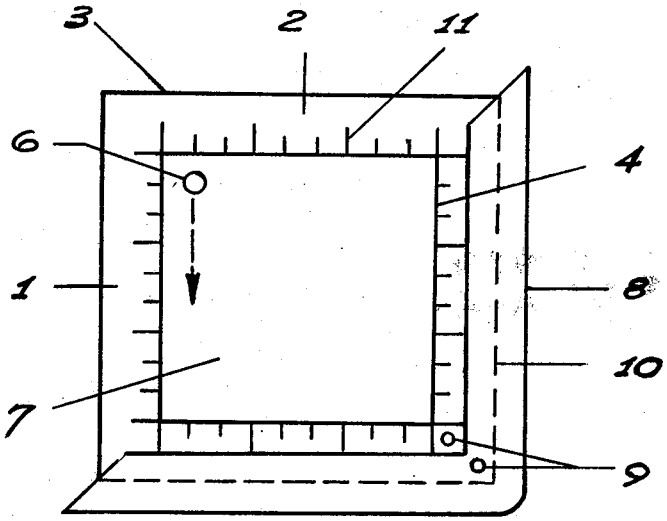
Figure 2:
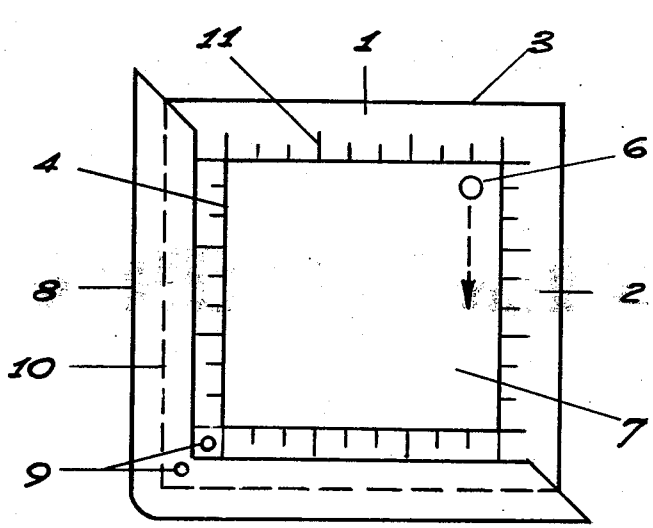
Figure 3:
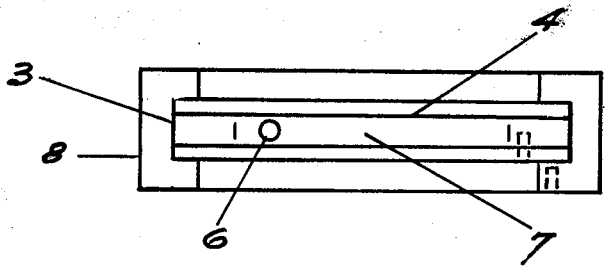
Figure 4:
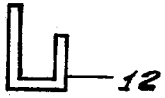

FIG. 1 shows timing apparatus set to time player P1.
FIG. 2 shows timing apparatus set to time player P2.
FIG. 3 shows plan view of timing apparatus.
FIG. 4 shows securing pin.

PREFERRED EMBODIMENT

The accompanying drawings are a preferred embodiment of the dual timing apparatus.

The apparatus is constructed in the form of a plate-type enclosure 3 having a fluid-filled cavity 4 which forms a rectangular layer 7 of uniform thickness just sufficient to restrict movement of a ball float or body 6 to two directions only.

Time is measured based on the rate at which the body 6 sinks into the fluid when acted upon by gravity.

Total elapsed times are read off the graduation scales 11 obtained from calibration and shown on the enclosure 3.

The fluid 7 used in this case is a colorless viscous liquid similar to Dow Corning DC 200 silicone oil whose viscosity is stable over a wide range of room temperatures, and the body 6 is a material whose density is slightly greater than that of the liquid 7. Alternatively, the body 6 can be material whose density is slightly less than that of the liquid 7, in which case, time is measured as the body 6 tends to rise from below the liquid 7.

The plate-type enclosure 3 is attached to a right angular support base 8 such that when said base 8 rests on a level surface, the rectangular cavity 4 assumes a normally upright position in which the vertical sides are parallel to the vertical leg of said base 8, and the horizontal sides are parallel to the horizontal leg of said base 8. Thus, when the base 8 is rotated from one leg to the other, it causes movement of the body 6 relative to one side of the cavity 4 to stop, and correspondingly, movement of the same body 6 relative to an adjacent side of the cavity 4 to start. The right angular base 8 is to restrict the timer to just two stable operating positions.

The enclosure 3 is constructed from a transparent material, glass or plastic, so that the body 6 can be visible anywhere in the liquid layer 7.

The rectangular cavity 4 in this case is a square, but it can also be an oblong, depending on the degree of handicap that is needed by the slower player. For example, a square configuration provides equal time allotment for both players. An oblong configuration provides more time for one player than the other. Also, the cavity 4 is not size restrictive. It depends on the time duration required for the game and the relative densities of the liquid and the body.

Another variation of the enclosure 3, herein described, is a block-type enclosure having a liquid-filled cavity configuration of a cube. In such a case, the body 6 is capable of moving in three mutually perpendicular directions to time three players.

Attachment of the enclosure 3 to the support base 8 is by means of a groove 10 formed in the base 8 and a U-shaped pin 12 to secure both components in place. The pin 12 is removed from holes 9 in said base 8 when the timer is to be reset.

An alternate means of attachment can be by hinges or other mechanical device.

Except as noted, all components of the timing apparatus can be constructed from plastic, wood, glass, metal or a combination thereof.

While the above description is considered to be a preferred embodiment of the present invention, it will be obvious to those skilled in the art that various changes and modifications may be made therein without departing from the intent and scope of the invention.

What I claim is:

1. A timing apparatus comprising an enclosure having a rectangular cavity filled with a fluid, a body that is free to move within said fluid and a base wherein a. said fluid-filled cavity forms a fluid layer, rectangular in shape, with uniform thickness sufficient to permit freedom of movement of said body in at least two directions, b. said body has a density slightly different from that of the fluid, c. said enclosure is constructed of a material such that said movement of said body is completely visible anywhere within said fluid-filled cavity, d. said base is right angular so that on a level surface, it is rotatable in a vertical plane from one leg to the other to restrict said apparatus to just two stable operating positions.

e. said enclosure is attached to said base such that the legs of said base are parallel to adjacent sides of said rectangular cavity, f. said rectangular cavity, when in one of said stable positions or the other, has a normally upright orientation with adjacent sides horizontal and vertical so that said body, under influence of gravity or buoyancy, moves in a parallel path relative one of said adjacent sides or the other.

2. The timing apparatus of claim 1, wherein the enclosure is supported by a horizontal base.

3. The timing apparatus of claim 1, wherein the enclosure is free standing with integral base.

4. The timing apparatus of claim 1, wherein the fluid-filled cavity has an oblong configuration.

5. The timing apparatus of claim 1, wherein the enclosure attachment to the base is by hinges or other mechanical means.

6. The timing apparatus of claim 1, wherein the thickness or depth of the fluid-filled cavity is large enough to permit movement of the body in three mutually perpendicular directions.

* * * * *